United States Patent [19]

Schultes et al.

[11] 4,244,648

[45] Jan. 13, 1981

[54] MISFEED DETECTOR FOR COPY MACHINE

[75] Inventors: Max Schultes, Old Tappan, N.J.; Dietmar Eberlein, New City, N.Y.

[73] Assignee: Savin Corporation, Valhalla, N.Y.

[21] Appl. No.: 43,755

[22] Filed: May 30, 1979

Related U.S. Application Data

[63] Continuation of Ser. No. 805,836, Jun. 13, 1977, abandoned.

[51] Int. Cl.[3] ..... G03G 15/00

[52] U.S. Cl. ..... 355/14 SH; 271/DIG. 9; 271/258; 271/308; 271/311; 355/3 SH

[58] Field of Search ..... 355/3 R, 3 SH, 14 SH; 271/DIG. 2, DIG. 9, 258, 262, 263, 307, 308, 309, 310, 311, 312

[56] References Cited

U.S. PATENT DOCUMENTS

| | | | |
|---|---|---|---|
| 3,791,729 | 2/1974 | Steiner | 355/3 R |
| 3,820,776 | 6/1974 | Fujimoto et al. | 271/80 |
| 3,831,933 | 8/1974 | Fantozzi | 271/258 |
| 3,833,896 | 9/1974 | Suzuki | 271/258 X |
| 3,912,256 | 10/1975 | Nagahara | 271/174 |
| 3,918,403 | 11/1975 | Vock | 355/3 TR X |
| 3,999,851 | 12/1976 | Sakamaki | 355/14 |
| 4,060,320 | 11/1977 | Doi et al. | 355/3 R |
| 4,073,585 | 2/1978 | Kobayashi et al. | 355/14 |

OTHER PUBLICATIONS

Beaudrot, C. B., "Backup Pick-Off Control", IBM Technical Disclosure Bulletin, vol. 15, No. 7, Dec. 1972, p. 2195.

*Primary Examiner*—Fred L. Braun

*Attorney, Agent, or Firm*—Shenier & O'Connor

[57] ABSTRACT

A jam detector for use in a plain paper copying machine of the type in which the copy paper to which the image has been transferred from the surface of a photoconductive drum is removed from the drum by a pick-off element which acts on a narrow strip of the copy paper extending rearwardly from the leading edge of the paper along one side edge thereof wherein the leading edge of a narrow or skewed or otherwise misdirected copy paper which misses the pick-off element is engaged by a jam detector element positioned in the path of the paper a predetermined distance inboard of the pick-off element to cause the jam detector element to disable the machine and to illuminate the jam indicating signal light. The arrangement is such that the machine cannot be reset for the next operation until such time as the jammed copy paper is removed from the machine. In an alternate embodiment, the jam detector element directs the sheet which has missed the pick-off element to guides which carry the paper back toward the output rolls of the machine which feed the paper back to the usual delivery location.

16 Claims, 6 Drawing Figures

MISFEED DETECTOR FOR COPY MACHINE

This is a continuation of application Ser. No. 805,836, filed June 13, 1977, now abandoned.

BACKGROUND OF THE INVENTION

There are known in the prior art plain paper electrostatic copying machines in which a drum carries a surface coating of photoconductive material such, for example, as selenium. The surface of the drum is moved successively past a charging station at which a corona applies uniform electrostatic charge over the surface of the drum and then to an exposure station at which the charged surface is exposed to an image of the original to be copied. In one particular form of such machine, a scanning system reciprocates below a glass platen on which the original is placed face down so that a line image of the original is translated to the moving drum surface at the exposure station. Further, as is known in the art, the surface of the drum in relatively light areas loses its charge while retaining its charge in relatively darker areas representing the printed areas of the original, so that the drum surface upon leaving the exposure station carries a latent electrostatic image of the original to be copied.

After having left the exposure station, the drum surface moves through a developer station at which a developer carrying particles of toner is applied to the drum surface so as to develop the latent image. Certain machines employ dry developer systems while others employ wet developer systems.

Upon leaving the developer station, the surface of the photoconductive drum enters a transfer station at which the developed image on the drum is transferred to the surface of a sheet of plain paper fed to the drum so as to pass through the transfer station in contact with the drum. Transfer may be effected, for example, by means of a transfer corona.

Following the transfer operation, the copy sheet to which the image has been transferred is picked-off the surface of the drum and is moved into a delivery system which transports the copy out of the machine to a tray, or the like, at which it is accessible to the user. In one particular type of pick-off system employed in the prior art, a narrow strip of the copy material extending rearwardly from the leading edge along a side thereof moves over a stationary flexible band conforming to the configuration of the drum over a portion of the circumference thereof and mounted in closely spaced relationship thereto at the edge thereof. At the point at which the picking-off operation is to take place, a struck out portion of the band moves the corner of the sheet forming the initial part of the narrow strip referred to hereinabove away from the surface of the drum and into the nip between a take-off roller and a belt. This operation is sufficient to reverse the direction of movement of the sheet and to feed it into the nip between transport rollers which move the sheet into a drying system from which the sheet passes to delivery rollers which carry the sheet out of the machine to the delivery tray, or the like.

A machine of the type described above is provided with a cleaning system, located beyond the pick-off station with reference to the direction of drum movement, which operates to remove any residual toner particles from the surface of the drum before the next operation of the machine takes place. More particularly, in one particular type of cleaning system, a sponge roller in engagement with the surface of the drum rotates in such a direction that the portion of its surface which is in engagement with the drum surface moves in the opposite direction thereto. This sponge roller normally is wet with developer to facilitate the cleaning action. It will readily be appreciated that, after a period of time in use, this roller becomes relatively black in appearance.

A further feature of the machine of the type described hereinabove is an arrangement for indicating a misfeed to the machine operator to permit the operator to correct the condition before the next machine operation. When such a condition occurs, a portion of the machine cabinet can be opened to permit the user to view a limited portion of the machine, including the reversing roller which cooperates with the belt to form the nip into which the picked-off sheet is fed as well as the forwarding rollers and hold-down roller of the dryer system. If the user observes the misfed paper at the reversing roller, for example, or at the hold-down roller, these rollers can manually be removed to permit the misfed paper to be taken out of the machine. Before the machine can again be set in operation, however, a reset push-button must be operated to restore the electrical circuitry to a condition at which the machine can be operated.

While the machine described hereinabove functions satisfactorily in most instances it incorporates a serious disadvantage. That is, a sheet of copy paper carrying a developed image need be only slightly skewed or misaligned, or otherwise not properly oriented, when fed from the paper supply cassette to the drum in order completely to miss the metal strip comprising the pick-off element of the system.

Machines of the type described customarily are provided with cassettes containing supplies of paper of standard widths which are fed to the machine to receive the image from the drum. In some instances, it may be desirable to make a copy on a sheet which is narrower than the standard width. While this can be successfully achieved so long as the edge of the paper to be picked off the drum is aligned with the pick-off device, an inexperienced or careless operator may cause the narrow sheet to be fed to the drum with the edge to be engaged by the pick-off device out of alignment therewith.

In either of the two cases described hereinabove, the sheet will continue its travel and is likely to become wrapped around the cleaner roll. Under such conditions, the machine will indicate that a misfeed has occurred. In response to the indication, the operator will open the access door at the delivery end of the machine so as to be able to view the return roll and the other rollers of the delivery system. The cleaning roller, however, is not readily visible with the access door open and, in any event, a sheet of paper which has become wrapped around the roller rapidly is saturated with developer containing carbon black toner particles so that, even if the roller is partially visible, the operator will not readily observe the paper which has become wrapped around the roller. It is most likely that the usual operator will, as has in many instances actually occurred, assume that no misfeed exists. The operator then pushes the reset button and the machine is ready for the next operation.

The selenium surface of the photoconductive drum is notoriously prone to damage such as scratching, or the like, by any instrument or rough surface with which it may come into contact. The misfed sheet described hereinabove which becomes wrapped around the cleaner roll is wrinkled and dries out when the machine is not in use so as to form portions which will readily scratch the selenium surface when the machine is again set into operation. Under these conditions, the effectiveness of the surface in making copies is destroyed in a relatively short period of time. As a result, it becomes necessary to replace the drum which is one of the most expensive components of the machine.

We have invented a misfeed detector which overcomes the defects of machines of the type described hereinabove. Our misfeed detector prevents a copy which has missed the pick-off element from reaching the cleaning roll of the machine. One form of our jam detector disables the machine in response to a copy which has missed the pick-off element and prevents resetting of the machine until this copy is physically removed from the machine. Another form of our misfeed detector returns to the operator a copy sheet which has missed the pick-off element. Our device is readily installed on existing machines of the type described. It is relatively inexpensive for the result achieved thereby. It is certain in operation.

SUMMARY OF THE INVENTION

One object of our invention is to provide a jam detector for detecting copies which fail to be picked off a photoconductor drum after leaving the transfer station of a copying machine.

Another object of our invention is to provide a jam detector which is especially adapted for use on copying machines of the type employing a copy paper side edge pick-off device.

A further object of our invention is to provide a jam detector which is compatible with existing machines and which is adapted to be installed in machines in the field.

Yet another object of our invention is to provide a jam detector which prevents the electrical system of the machine from being reset until a copy which has missed the pick-off is removed from inside the machine.

A still further object of our invention is to provide a jam detector which directs a copy which has missed the normal pick-off to the copy delivery rolls of the machine.

A still further object of our invention is to provide a jam detector which is simple in construction and which is certain in operation.

Other and further objects of our invention will appear from the following description.

In general, our invention contemplates the provision of a jam detector which intercepts a copy which has missed the edge pick-off device of an electrostatic copying machine before it reaches the drum cleaning roll of the machine and which, in the preferred form of the invention, disables the electrical circuit of the machine including the reset portion thereof and lights the "misfeed" light until the intercepted copy has been removed from the machine. In another form of the invention, the intercepted copy is directed back toward the copy delivery rolls of the machine.

BRIEF DESCRIPTION OF THE DRAWINGS

In the accompanying drawings which form part of the instant specification and which are to be read in conjunction therewith and in which like reference numerals are used to indicate like parts in the various views.

DESCRIPTION OF THE PREFERRED EMBODIMENT

Figure 1:
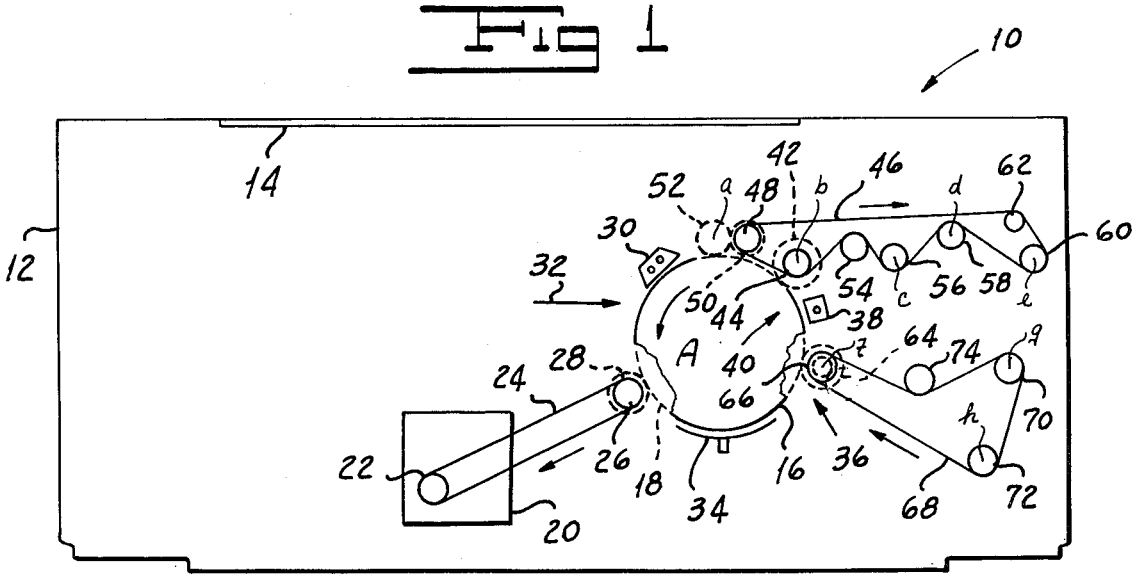
FIG. 1 is a simplified schematic view of the drive system of an electrostatic copying machine incorporating our jam detector with parts of the machine removed.
Figures 2, 3:
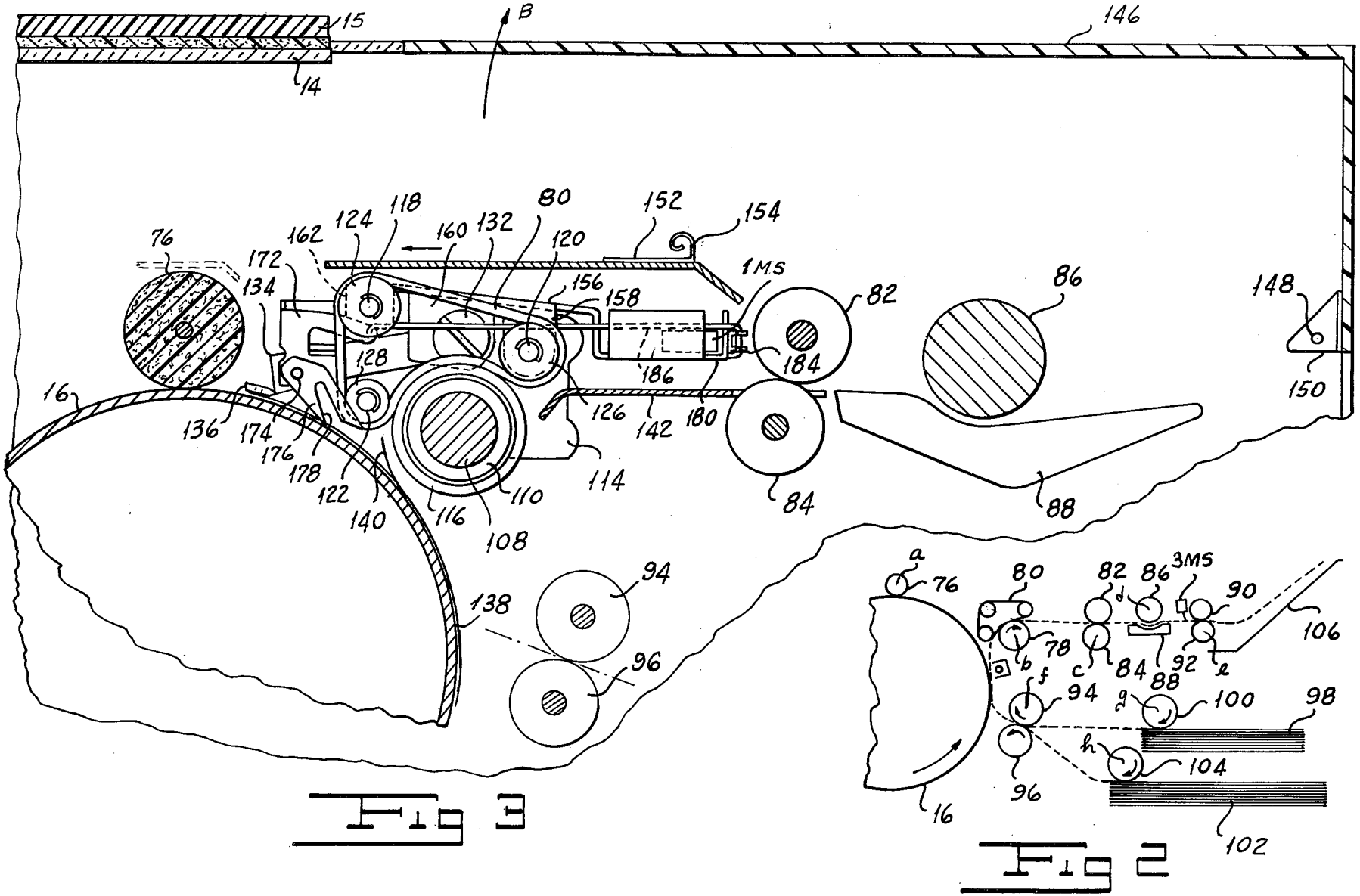
FIG. 2 is a diagrammatic view of the copy paper handling system of the electrostatic copier illustrated in FIG. 1.
FIG. 3 is a fragmentary section of an electrostatic copying machine provided with one form of our jam detector.

Referring now to FIGS. 1 and 2 of the drawings, a machine indicated generally by the reference character 10 with which our jam detector is used includes a cabinet 12, the top of which is provided with a transparent platen 14, normally covered by a cover 15 hinged to the cabinet. The cover can be moved away from the platen to permit an original to be placed face down on the platen. A drum 16 carrying a suitable photoconductor on the surface thereof is rotatably supported for movement in the cabinet 10 by any suitable means known to the art. In the schematic view in FIG. 1, for purposes of simplicity, we have indicated gears by broken lines and have indicated sprocket wheels in full lines. A gear 18 which rotates with the drum 16 is adapted to be driven to rotate the drum in the direction of the arrow A in FIG. 1. Machine 10 includes a prime mover 20, the output shaft of which carries a sprocket wheel 22 adapted to drive a pitch chain 24 to drive a sprocket wheel 26. Chain 24 moves in the direction of the arrow adjacent to the chain so that a gear 28 mounted on the shaft of sprocket wheel 26 for rotation therewith drives gear 18 to rotate the drum 16 in the direction of the arrow A.

Further, as is known in the art, as the drum 16 rotates in the direction of the arrow A, its surface moves successively past a corona 30, which is activated to produce a uniform electrostatic charge on the surface of the drum. After leaving the corona 30, the surface passes by an exposure station indicated by the arrow 32 at which a moving optical system scans the original which has been placed face down on platen 14 so as to translate a line image of the original to the surface of the moving drum 16. Since the details of the optical system, per se, form no part of our invention, they have not been shown in the drawings.

After leaving the exposure station 32, the surface of the drum moves through a developer unit 34 at which the latent electrostatic image thereon is subjected to the action of a liquid developer containing particles of toner which adhere to those areas of the drum surface which have retained their charge after exposure to the image. As the developed latent image moves further in the direction of the arrow A, a sheet of plain paper is fed to the drum at a station indicated generally by the reference character 36. The paper moves with the drum past a transfer corona 38 which is energized to cause the developed image to migrate from the surface of the drum to the underside of the paper. After transfer has thus been effected, the sheet carrying the developed and transferred image is carried away from the drum at a pick-off station indicated generally by the reference character 40.

A gear 42 which meshes with the drum gear 18 provides the input to the copy pick-off and delivery system. Gear 42 is on a shaft which is common with a sprocket wheel 44 so that gear 42 and sprocket wheel 44 rotate around an axis "b" which is the axis of the take-off roll to be described more fully hereinbelow. Sprocket wheel 44 drives pitch chain 46 in the direction of the arrow adjacent to the chain in FIG. 1. Chain 46 in turn drives a sprocket wheel 48, the shaft of which also carries a gear 50 which meshes with a gear 52 to drive gear 52 in a counterclockwise direction around the axis "a" of the cleaner roll to be described in detail hereinbelow.

Chain 46 also engages a tensioning sprocket wheel 54 and a sprocket wheel 56 mounted for rotation around the axis "c" of the lower of a pair of take-off rolls to be described hereinbelow. A hold-down roller sprocket wheel 58 is engaged by chain 46 so as to be driven in counterclockwise direction around the axis "d". Finally, the pitch chain 46 also drives a lower delivery roll sprocket wheel 60 mounted for movement around an axis "e". An idler sprocket wheel 62 completes the path of the chain back to sprocket wheel 48.

The drive system for the copy paper supply assembly includes a gear 64 adapted to be driven by the drum gear 18. A sprocket wheel 66 on a shaft common to the gear 64 is driven around an axis "f" to drive a pitch chain 68 in the direction of the arrow adjacent to the chain in FIG. 1. Chain 68 drives respective upper and lower paper supply roll sprocket wheels 70 and 72 mounted for movement around respective axes "g" and "h". A tensioning sprocket wheel 74 is arranged to give sufficient tension to the chain 68. All of the gear, sprocket wheel and pitch chain mechanism just described is located at the rear of the machine 10.

As can be seen by reference to FIG. 2, a spongy cleaner roll 76 mounted for movement around the axis "a" is driven by gear 52 so that the surface of the cleaning roll in engagement with the drum moves in a direction opposite to the direction of movement of the drum surface.

A take-off roll 78, more fully to be described hereinafter, cooperates with a belt 80 to deliver a picked off sheet to the nip between a pair of take-off rolls 82 and 84, the roll 84 of which is mounted for movement around the axis "c". After leaving the rolls 82 and 84, the sheet passes between a hold-down roller 86 mounted for movement around the axis "d" so as to be brought into operative relationship with a dryer 88. As the sheet leaves the dryer 88, it enters the nip between delivery rolls 90 and 92, the lower roll 92 of which is mounted for movement around the axis "e". These rolls pass the copy to a tray 106, or the like.

The machine with which our jam detector is used includes two cassettes holding respective supplies 98 and 102 of paper of different sizes. Respective paper feeding rolls 100 and 104 associated with the supplies 98 and 102 are mounted for movement at the axes "g" and "h". Means (not shown) under the control of the operator is adapted to be actuated selectively to bring one or the other of the supplies 98 or 102 into cooperative relationship with its associated roller 100 or 104. The operative roller delivers a sheet to the nip between a pair of feed rolls 94 and 96, the upper one of which is mounted for movement at the axis "f". Rolls 94 and 96 deliver the fed sheet to the surface of the drum 16. The structure thus far described is that of a machine to which our jam detector is applied.

Figure 4:
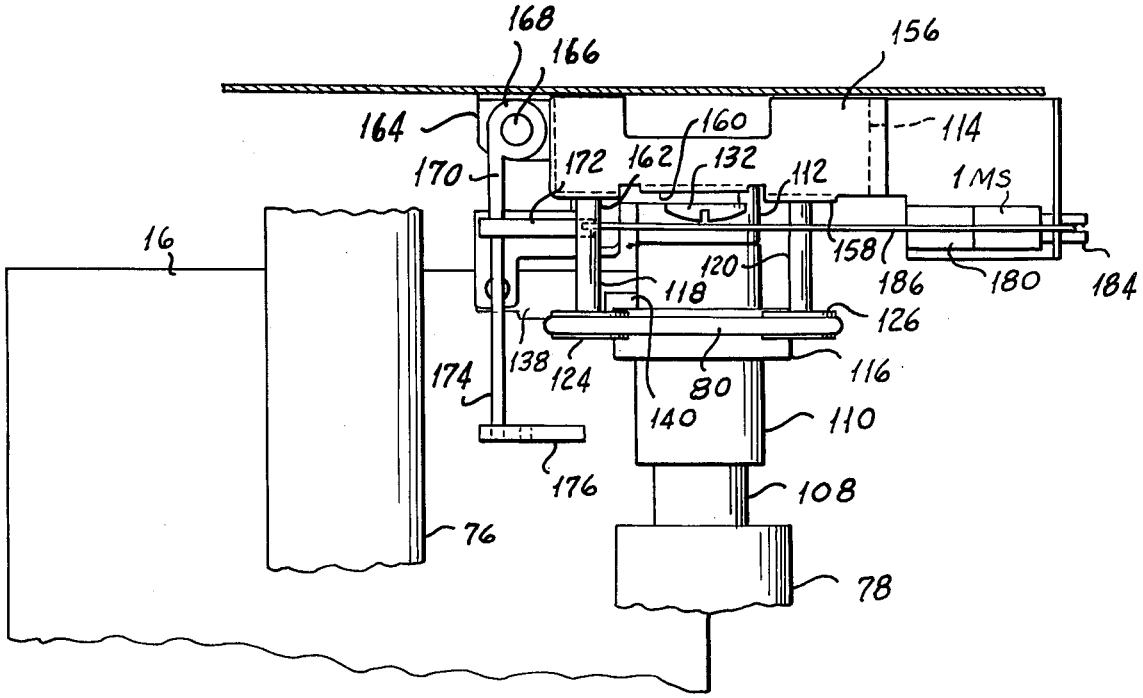
FIG. 4 is a fragmentary top plan of the form of our jam detector illustrated in FIG. 3.

Referring now more particularly to FIGS. 3 and 4, the pick-off and copy removing mechanism of the machine to which our jam detector is applied includes the reversing roller 78 which has a reduced diameter portion 108 which is received in a receptacle portion 110, supported in a bearing 112 carried by a gear housing 114, which receives the gear 42 for driving the return roller 78. Roller 78 is spring-loaded by means (not shown) for movement in an axial direction to seat the reduced diameter portion 108 in the receptacle 110, so that the roller can be moved away from the drum to clear a jam, if necessary. Roller portion 110 also carries a rubber collar or tire 116 for cooperation with belt 80.

Respective studs 118, 120 and 122 screwed into the gear housing 114 rotatably support respective pulleys 124, 126 and 128, which carry the rubber belt 80. A screw 132 secures a bracket 134 to the housing 114. Bracket 134 includes an extension 136 to which the upper end of a pick-off blade 138 is attached by any suitable means such, for example, as by a rivet or the like. The lower end of the pick-off blade 138 is supported in another bracket (not shown). It will be seen that the blade 138, which is formed of a suitable flexible material extends for a certain circumferential distance around the drum 16 between the location at which rollers 94 and 96 feed a sheet of paper to the drum and a point between the reversing roller 78 and the cleaning roller 76. For purposes of clarity, we have shown the path of a sheet of paper being delivered to drum 16 by rolls 94 and 96 as a dot-dash line in FIG. 3. A narrow strip extending rearwardly from the leading edge of a sheet fed to the drum 16 for a predetermined distance along a side edge thereof will ride along the outer surface of the blade 138. Blade 138 is formed with an offset 140 which directs the edge of the sheet riding along the blade 138 away from the drum 16 and into the nip between the belt 80 and the rubber tire 116 forming a part of the reversing roll 78. This action reverses the direction of movement of the sheet to cause it to move along a guide 142 which directs it into the nip between the forwarding rollers 82 and 84 and thence to the space between the hold-down roller 86 and the dryer 88 and, finally, to the nip between the delivery rollers 90 and 92. As has been pointed out hereinabove, in passing through the delivery rollers 90 and 92, the leading edge of the paper actuates a microswitch 3MS.

The side of the machine adjacent to which the delivery mechanism just described is located is provided with a cover 146 carrying brackets 150 which support the cover on pivot pins 148 for movement away from the housing 12 in the direction of the arrow B in FIG. 3 to expose the delivery mechanism to permit paper jams to be cleared. In additon, there is provided a cover 152 having a handle 154. The cover 152 normally overlies the paper removal system, including roller 78 and belt 130. It may be moved to a position at which this portion of the apparatus is accessible so that roller 78 can be moved away from the drum 16 in the manner described hereinabove to clear a paper jam. It will readily be apparent that, even with the cover 146 open and with the slide 152 moved to the position at which the paper removal mechanism is accessible, the cleaning roller 76 is not readily visible to the machine operator.

The mechanism which has thus far been described is incorporated in a machine for which our jam detector is especially adapted. It will readily be appreciated that a paper being fed to the drum 16 for transfer of an image thereto need be only slightly skewed or otherwise misdirected and it will miss the offset 140 of the pick-off blade 138, so that it will continue to move toward the cleaning roller 76 rather than being removed from the machine. Moreover, when such is the case, the paper tends to be wrapped around the roller 76 to create the serious problem pointed out hereinabove of damage to the surface of the drum 16. The same situation occurs when a relatively narrow sheet is fed to the drum 16 with the edge to be engaged by the offset 140 out of alignment therewith.

One form of our jam detector includes a bracket 156, the upper portion of which is adapted to fit over the upper surface of the housing 114. Bracket 156 is formed with respective spaced ears 158, 160 and 162 extending downwardly from the inner edge of the bracket. These ears 158, 160 and 162 have respective openings for receiving stud 120, screw 132 and stud 118. By virtue of the assembly of the pick-off blade, upper support bracket screw 132 and the studs 118 and 120 on the housing 114, bracket 156 is securely held in place.

We form the left end of bracket 156, as viewed in FIG. 4, with a platform 164 carrying a vertical pivot pin 166 which receives the hub 168 of an arm 170. An actuator 172 carried by arm 170 for movement therewith supports a shaft 174 which extends generally axially of the drum 16 for a predetermined distance inwardly of the drum 16 from the location of the offset 140. The specific distance for which the shaft 174 extends inwardly of the drum 16 is determined empirically as a result of a field experience, so as to avoid substantially all of the misfeeds or jams owing to copies which miss the pick-off of the machine. The end of shaft 174 carries a shoe 176 formed of a suitable material, such for example as polytetrafluoroethylene, which will not scratch the delicate surface of the drum 16. We form shoe 176 with an opening or slot 178, which receives the leading edge of a sheet which has missed the pick-off 140. The force exerted by the leading edge of such a sheet on the shoe 176 causes arm 170 to pivot slightly in a clockwise direction as viewed in FIG. 4.

It may be in some instances that the paper will not stick to the drum. Such might be the case, for example, when the transfer corona is inoperative. When this occurs, a misfed sheet may miss shoe 176 entirely. If that occurs, the misfed sheet will engage the actuator 172 and will operate microswitch 1MS in the same manner as when a sheet rides into slot 178 in shoe 176.

A second bracket platform 180 on the end of bracket 156 remote from the platform 164 carries a normally closed microswitch 1MS. Actuator 172 receives a hook formed in one end of a connecting wire 186, the other end of which is formed with a hook received by the actuator 184 of the microswitch 1MS. Thus, as arm 170 pivots slightly in a clockwise direction, as viewed in FIG. 4, in response to bottoming of the leading edge of a misfed copy in the slot 178, connecting wire 186 moves actuator 184 to open the normally closed microswitch 1MS.

Figures 5, 6:
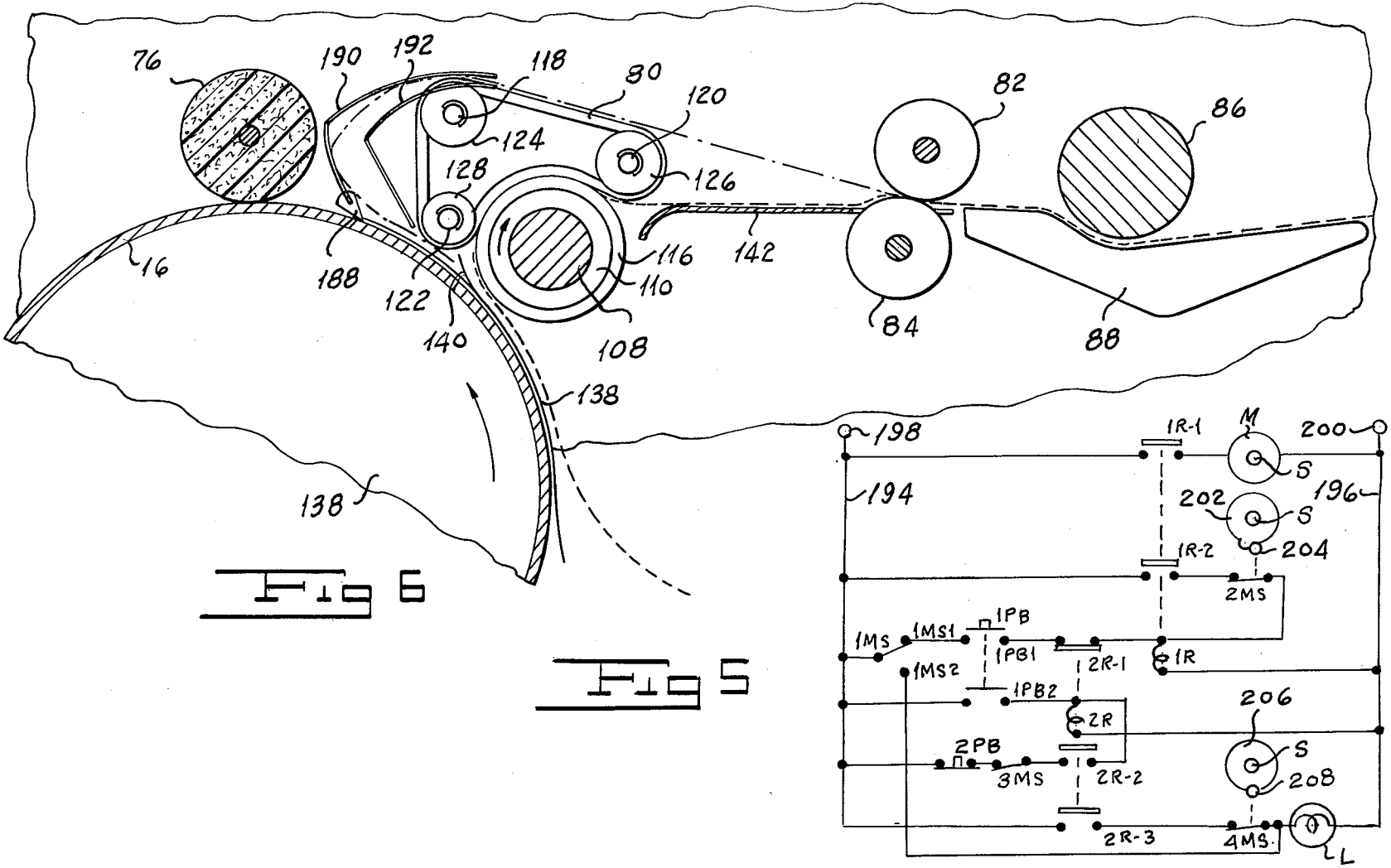
FIG. 5 is a schematic view of a portion of the electrical control circuit of an electrostatic copying machine provided with the form of our jam detector illustrated in FIGS. 4 and 5.
FIG. 6 is a fragmentary section of an electrostatic copying machine provided with an alternate form of our jam detector.

Referring now to FIG. 5, we have shown a portion of one form of electrical circuit which might be employed on a machine of the type to which the form of our jam detector illustrated in FIGS. 3 and 4 may be applied. This circuit includes respective conductors 194 and 196 connected to the terminals 198 and 200 of a suitable source of electrical potential. A push-button 1PB is adapted to be actuated to energize a relay winding 1R from line 194 through switch 1MS in engagement with an upper contact 1MS1, the closed push-button switch 1PB1, a normally closed switch 2R1, the winding 1R to conductor 196. Energization of winding 1R completes its own holding circuit through a microswitch 2MS by closing switch 1R-2 to bypass the circuit including switch contacts 1PB1. Energization of winding 1R also closes a switch 1R-1 to energize a motor M forming part of the drive system 20 shown in FIG. 1. Upon its energization, motor M drives its shaft S. Shaft S also carries a cam 202 adapted to rotate in a clockwise direction as viewed in FIG. 5 to actuate a follower 204 at the end of a full revolution of shaft 202 to open microswitch 2MS to de-energize winding 1R. In the arrangement shown, one revolution of shaft S is considered to represent a complete cycle of the machine. It will readily be appreciated that the end of a machine cycle might be indicated in other ways as, for example, by the return of a reciprocating optical system to its home position, or by the sensing of the trailing edge of a copy leaving the machine or the like.

Actuation of push-button switch 1PB also closes contacts 1PB2 to energize a second relay winding 2R. When energized winding 2R opens the normally closed contacts 2R-1 to prevent winding 1R from being re-energized by operation of push-button 1PB until after the winding 2R is de-energized. It is to be understood that winding 1R closes switch 1R-2 to complete its own holding circuit before winding 2R opens switch 2R-1.

Energization of winding 2R also closes switch 2R-2 to complete a holding circuit for winding 2R through a normally closed microswitch 3MS and a second push-button switch 2PB. In addition to closing the normally open switch 2R-2, winding 2R when energized closes a normally open switch 2R-3 to energize a "misfeed" lamp L through a normally closed microswitch 4MS. Shaft S of motor M carries a second cam 206 adapted to actuate a follower 208 to open microswitch 4MS as soon as the motor begins to run so that the misfeed lamp L cannot light upon the closing of switch 2R-3 until the end of a cycle of operation of the machine.

In normal operation of the machine with which the form of our detector shown in FIGS. 3 to 5 is employed, push-button 1PB is actuated to energize winding 1R to initiate a copying operation. The winding will remain energized for a full revolution of motor M and will be de-energized by the opening of switch 2MS at the end of the machine cycle to ready the machine for the next operation. Closing of the switch 1PB2 when push-button 1PB is operated also energizes winding 2R. In normal operation of the machine, a copy being delivered by the rolls 90 and 92 opens the normally closed microswitch 3MS. If this does not occur, indicating a misfeed at some location in the machine, winding 2R remains energized at the end of a cycle of operation of the machine. This prevents re-energization of winding 1R by closing switch 1PB1. In addition, at the end of a cycle of operation, the misfeed lamp L is lit through switch 4MS and switch 2R-3. The operator of the machine then lifts the cover 146 to determine where the misfeed has occurred. In most instances, such a misfeed will be either at the roller 78 or at the roller 86. The paper can be removed by moving these rollers away from the drum.

Even after that has been done, however, the machine is not automatically restored to normal operation. Before normal operation can proceed, reset push-button switch 2PB must be operated to open the holding circuit of winding 2R to de-energize the winding. Other types of misfeed than those to which our invention is directed may also be accounted for by the circuit actually used.

The portion of the operation of the circuit just described emphasizes the problem to which our invention provides a solution. This can readily be demonstrated by considering the action of the machine in the absence of our jam detector. Assuming that a copy sheet misses the pick-off element 140 and moves toward the cleaning roll 76 so as to become wrapped therearound, as has been explained hereinabove, the sheet will rapidly become blackened with toner particles. Under such a condition, switch 3MS will not be opened by an emerging copy and, at the end of the machine cycle, lamp L will be lit indicating a misfeed. The operator of the machine then will open the cover 146 and move slide 154 to the left to the broken line position indicated in FIG. 3 in an attempt to locate the jam or misfeed. Under these conditions, while all of the apparatus which is intended to carry the copy from the pick-off point to the tray 106 is readily visible, the cleaning roll 76 around which the copy has become wrapped is not so readily visible. In addition, even the limited view of this roll provided under the circumstances described is not particularly helpful owing to the fact that the copy is saturated with developer and completely blackened by toner particles so as to be relatively indistinguishable from the roller itself. In these circumstances, most operators will merely return the slide 152 to its initial position, close the cover 146 and actuate the reset push-button 2PB so as to return the machine to operating condition. This, of course, as has been pointed out hereinabove is precisely the wrong procedure to follow. Continued operation of the machine under such condition will inevitably result in damage to the surface of the drum 16.

When the machine is equipped with our jam detector, the sheet which has missed the pick-off element 140 enters the slot 178 in the shoe 176, rides up the slot and bottoms therein so as to pivot arm 170 slightly in a clockwise direction as viewed in FIG. 4. This action actuates switch 1MS to move the arm thereof from the contact 1MS1 to contact 1MS2. This action produces two results. First, it disables the push-button circuit for initiating energization of the winding 1R. Secondly, it completes a circuit to the misfeed lamp L so that the lamp will remain illuminated even though the reset push-button 2PB of the machine is actuated to de-energize winding 2R. The machine remains disabled until the operator actually removes the misfed sheet from the shoe 176 to permit the parts of the reset mechanism to return to their initial positions under the action of switch 1MS in returning to its normal condition.

Referring now to FIG. 6, in an alternate embodiment of our jam detector, a shoe 188 is supported on the lower end of a first guide 190 at a position along the axis of the drum corresponding to the position of the shoe 176 of the form of our invention illustrated in FIGS. 3 and 4. Shoe 188 is supported on the guide 190 in such a manner that it rides lightly on the surface of drum 16. It is formed of the same polytetrafluoroethylene material as is the shoe 176. Form of apparatus illustrated in FIG. 6 includes a second guide 192. In this figure of the drawings, we have indicated the path of a normally picked off copy by broken lines and have indicated the path of a copy which has failed to be picked off by dot-dash lines. As can be seen, guides 190 and 192 are so constructed as to direct the sheet which has missed pick-off element 40 rearwardly toward guide 142 so that it enters the rolls 82 and 84 and is returned to the operator as if no misoperation had occurred. Guides 190 and 192 extend axially of the drum 16 for a sufficient distance to ensure adequate control of the sheet as it moves through the space between the guides.

It will be seen that we have accomplished the objects of our invention. We have provided a jam detector for detecting copies which have failed to be picked-off a photoconductor drum after leaving the transfer station of a copying machine. Our jam detector is especially adapted for use on copying machines of the type employing a copy paper side edge pick-off device. Our jam detector is compatible with existing machines and can be installed on machines in the field. One form of our jam detector prevents the electrical system of the machine from being reset until the copy which has missed the pick-off is physically removed from inside the machine. Another form of our jam detector directs a copy which has missed the normal pick-off back to the copy delivery rolls of the machine. Our jam detector is simple in construction and in operation for the result achieved thereby.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In a copying machine of the type in which a surface carrying a developed image is moved successively past a first station at which a length of copy material is fed to said surface for movement therewith and past a second station at which said image is transferred to said copy material and past a third station at which a pick-off means is adapted to lift a leading edge portion of said length off said surface to pick said length off said surface and past a fourth station at which a cleaning element acts on said surface, apparatus including a misfeed detector element formed with a recess opening in a direction opposite to the direction of movement of said surface for receiving the leading edge of a length of copy material and means mounting said misfeed detector element adjacent to said surface at a location between said third and fourth stations with a portion thereof leading into said recess resting on said surface in normal operation of said machine to intercept the leading edge of a length of copy material which has not been picked off by said pick-off means to direct said leading edge into said recess, and to prevent movement of said length of copy material to said cleaning station.

2. Apparatus as in claim 1 including means responsive to interception of a length of copy material by said misfeed detector element for disabling said machine.

3. Apparatus as in claim 2 in which said disabling means comprises means mounting said misfeed detector element for movement in response to engagement by a length of copy material and means responsive to movement of said misfeed detector element for disabling said machine.

4. Apparatus as in claim 3 in which said misfeed detector element mounting means comprises an arm and means mounting said arm for movement around an axis, and in which said disabling means comprises means responsive to movement of said arm.

5. Apparatus as in claim 4 in which said misfeed detector element comprises a shoe, and in which said mounting means comprises a shaft on said arm for supporting said shoe at a location at which it rests on said surface.

6. Apparatus as in claim 1 in which said misfeed detector element comprises a shoe formed with a ramp leading into said recess and in which said mounting means comprises means mounting said shoe with the shoe resting on said surface whereby the leading edge of a copy material which has missed said pick-off element rides up said ramp.

7. Apparatus as in claim 6 in which the bottom of said recess at the top of said ramp prevents further movement of the leading edge of a copy material.

8. In a copying machine in which a surface carrying a developed image is moved successively past a first station at which a sheet of copy material is fed to said surface from a supply in a first general direction for movement with said surface, through a second station at which said image is transferred to said sheet and to a third station at which said sheet is to be removed from said surface, apparatus including a housing for said copying machine having a delivery opening through which copies are to be delivered to the user of the machine, pick-off means at said third station for removing from said surface a sheet to which an image has been transferred and for feeding said sheet toward said delivery opening in a direction which is generally opposite to said first direction, reversing guide means located downstream of said pick-off means for reversing the direction of a sheet fed thereto to direct said last-named sheet toward said delivery opening and means for directing a misfed sheet which has not been picked off by said pick-off means from said surface into said guide means.

9. Apparatus as in claim 8 in which said guide means comprise upper and lower guides and in which said misfed sheet directing means comprises a shoe in engagement with said surface for directing a misfed sheet into the space between said guides.

10. In a copying machine of the type in which a surface carrying a developed image is moved successively past a first station at which a length of copy material is fed to said surface for movement therewith and past a second station at which said image is transferred to said copy material and past a third station at which a pick-off means is adapted to lift a portion of the leading edge of said length off said surface to pick said length of copy material off said surface and past a fourth station at which a cleaning element acts on said surface and having a control circuit including means responsive to jamming of a picked-off length of copy material for disabling said machine and reset means for overriding said disabling means, apparatus including a misfeed detector element, means mounting said misfeed detector element adjacent to said surface at a location between said third and fourth stations to intercept the leading edge of a length of copy material, said leading edge portion of which has not been picked up by said pick-off means, and means responsive to engagement of said misfeed detector element for acting on said control circuit to prevent reoperation of said machine until said copy material is removed from the machine, said means for acting on said circuit comprising means for disabling said machine and for rendering said overriding means ineffective in restoring said machine to operation until the copy material engaging said misfeed detector element is removed from said machine.

11. Apparatus as in claim 10 in which said control circuit comprises a source of power and a relay adapted to be energized from said source of power in the course of a cycle of operation of said machine and a misfeed lamp, said means responsive to misfeed of a picked-off copy material including a normally closed switch connected between said relay and said source and a normally open switch between said lamp and said source and in which said means responsive to engagement of said misfeed detector element comprises switch means normally completing a circuit between said normally closed switch and said relay and adapted to be actuated to break said circuit between said normally closed switch and said relay and to complete a circuit between said source and said lamp independently of said normally open switch.

12. In a copying machine having a surface carrying an image and adapted to be moved successively past a first station at which a length of copy material is fed to said surface and a second station at which said image is transferred to said copy material and a third station at which said length of copy material is to be removed from said surface by a pick-off element which acts on said length only at a corner thereof which is leading with reference to the direction of movement of said length of copy material to direct said length to means for delivering said length to a delivery opening and a fourth station at which a cleaning element acts on said surface and having a control circuit, apparatus including a misfeed detector element formed with a recess opening in a direction opposite to the direction of movement of said surface for receiving the leading edge of a length of copy material, means mounting said misfeed detector element adjacent to said surface at a location between said third and fourth stations and spaced along said surface from said pick-off element inwardly with reference to the direction of movement of copy material with a portion thereof leading into said recess resting on said surface in normal operation of said machine to intercept the leading edge of a length of copy material which has missed said pick-off element to direct said leading edge into said recess, and means responsive to engagement of said leading edge with the base of said recess for acting on said control circuit to stop said length and to prevent reoperation of said machine until said copy material engaging said misfeed detector element is removed from the machine.

13. Apparatus as in claim 12 in which said mounting means mounts said misfeed detector element for movement in response to engagement by the leading edge of a length of copy material and in which said means for acting on said control circuit comprises switch means and means responsive to movement of said element for actuating said switch means.

14. Apparatus as in claim 13 in which said control circuit comprises a relay and misfeed signal lamp, said switch means normally completing a circuit to said relay and when actuated completing a circuit to said misfeed signal lamp.

15. Apparatus as in claim 12 in which the control circuit of said machine includes means responsive to jamming of picked-off copy material for disabling said machine and reset means for overriding said disabling means, and in which said means responsive to engagement of said misfeed detector element comprises means for disabling said machine and for rendering said overriding means ineffective in restoring said machine to operation until the copy engaging said misfeed detector element is removed from said machine.

16. Apparatus as in claim 15 in which said control circuit comprises a source of power and a relay adapted to be energized from said source of power in the course of a cycle of operation of said machine and a misfeed lamp, said means responsive to misfeed of a picked-off copy material including a normally closed switch connected between said relay and said source and a normally open switch between said lamp and said source and in which said means responsive to engagement of said misfeed detector element comprises switch means normally completing a circuit between said normally closed switch and said relay and adapted to be actuated to break said circuit between said normally closed switch and said relay and to complete a circuit between said source and said lamp independently of said normally open switch.

* * * * *